US007163124B2

(12) United States Patent
Bushman et al.

(10) Patent No.: US 7,163,124 B2
(45) Date of Patent: Jan. 16, 2007

(54) PAPER WIPE CLEANING SYSTEM

(75) Inventors: Donald W. Bushman, Caledonia, MI (US); Marianne D. Davison, Grand Rapids, MI (US); Charles L. Stamm, Fort Mill, SC (US); Robert D. Faber, Grand Rapids, MI (US)

(73) Assignee: Access Business Group International LLC, Ada, MI (US)

( * ) Notice: Subject to any disclaimer, the term of this patent is extended or adjusted under 35 U.S.C. 154(b) by 113 days.

(21) Appl. No.: 10/864,555

(22) Filed: Jun. 9, 2004

(65) Prior Publication Data

US 2005/0274729 A1 Dec. 15, 2005

(51) Int. Cl.
*B65D 83/00* (2006.01)
*B65H 1/00* (2006.01)
*A47F 1/04* (2006.01)

(52) U.S. Cl. ..... 221/135; 221/33; 221/306; 221/307

(58) Field of Classification Search ..... 215/365; 40/310, 312; 73/149, 426, 427; 221/63, 221/49, 197; 705/1; 206/77.1
See application file for complete search history.

(56) References Cited

U.S. PATENT DOCUMENTS

| | | | | |
|---|---|---|---|---|
| 5,687,875 | A | 11/1997 | Watts et al. | |
| 5,762,710 | A | 6/1998 | Ngai et al. | |
| 5,857,502 | A * | 1/1999 | Buchalter | 141/100 |
| 6,056,235 | A | 5/2000 | Broznskiy | |
| 6,158,614 | A * | 12/2000 | Haines et al. | 221/63 |
| 6,179,162 | B1 * | 1/2001 | Motsenbocker | 221/150 A |

FOREIGN PATENT DOCUMENTS

| | | |
|---|---|---|
| EP | 0817876 | 5/2002 |
| WO | WO 96/30576 | 10/1996 |

* cited by examiner

*Primary Examiner*—Gene O. Crawford
*Assistant Examiner*—Timothy Waggoner
(74) *Attorney, Agent, or Firm*—Warner Norcross & Judd

(57) ABSTRACT

A customizable disposable paper wipe system in which the wipes are sold to the consumer in a dry state to permit the consumer to prepare customized pre-moistened wipes. In one embodiment, the dry wipes are provided to the consumer with a dispenser for dispensing the pre-moistened wipes. In this embodiment, the dispenser may include a diluent fill line and a legend dictating the amounts of various alternative cleaning agents that can be added to the predetermined amount of diluent for different applications.

3 Claims, 4 Drawing Sheets

PAPER WIPE CLEANING SYSTEM

BACKGROUND OF THE INVENTION

The present invention relates to cleaning supplies and more particularly to a paper wipe cleaning system.

There has been a steady increase in the use of pre-moistened disposable paper wipes in cleaning applications. Pre-moistened wipes are available with a variety of different cleaning agents, such as bathroom cleaning, car dashboard cleaner, kitchen cleaner, carpet cleaner, upholstery cleaner and glass cleaner. Pre-moistened wipes provide a number of advantages over other conventional cleaning methods because they are convenient to use and typically result in no dripping, overspray, heavy mist or spray fumes. Although pre-moistened wipes are convenient to use, consumers have generally been required to purchase and maintain a significant inventory of different types of wipes with different cleaning agents. To address this problem, a number of companies are offering multi-purpose wipes that are pre-moistened with a multi-purpose cleaner. For example, a single wipe is available with a cleaning agent that is at least generally appropriate for kitchen and bathroom use. Similarly, another company is offering disposable wipes that are pre-moistened with a cleaning agent that is at least generally appropriate for carpet and upholstery use. Although this approach reduces the required inventory of wipes, the cleaning agents may not be particularly well suited for each of the different cleaning applications.

SUMMARY OF THE INVENTION

The aforementioned problems are overcome by the present invention which provides a customizable disposable paper wipe system. The wipe system includes a wipe dispenser and a supply of dry disposable wipes that can be combined with the desired cleaning agent by the consumer. In this way, the consumer can customize the wipes with the desired cleaning agent.

In one embodiment, the wipes are pre-packaged with a dispenser that is suitable for use in dispensing the wipes. In this embodiment, the dispenser may be a conventional wipe dispenser in which a small portion of the wipe extends through a slot in the container. The dispenser may include a lid that can be closed to contain the exposed portion of the wipe and reduce the likelihood that it will dry out. The wipes may be interconnected or interleafed so that withdrawal of one wipe brings another into the dispensing slot. This permits the wipes to be used one after the other without the need to open the dispenser.

In one embodiment, the cleaning agent is diluted with water or other desired liquid prior to use. In this embodiment, the system may be designed for use with the same amount of water regardless of the cleaning agent. The dispenser may include a fill line to indicate the amount of water to be used when preparing the cleaning agent. The dispenser may also include a legend indicating the amount of cleaning agent to be added to the water for various cleaning applications.

The present invention provides a customizable disposable paper wipe system in which the consumer can easily pre-moisten the wipes with any of a variety of different cleaning agents. This permits a consumer to prepare wipes containing a variety of cleaning agents, such as bathroom, kitchen, glass and shower cleaners. The wipes can be prepared from a variety of cleaning agents already contained in the home, thereby eliminating the need to separately stock a wide variety of cleaning wipes. In embodiments in which the dry wipes are provided with a dispenser, the consumer has a convenient container in which to prepare the pre-moistened wipes and from which to dispense the wipes. In those embodiments which include a dilution fill line on the dispenser, the consumer has a simple and easy-to-use indicator for use in mixing the desired cleaning agent, especially when the dispenser is transparent or translucent. In those embodiments which include a mixing legend, consumers can easily determine the appropriate mix without reference to some outside source, such as an instruction manual.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
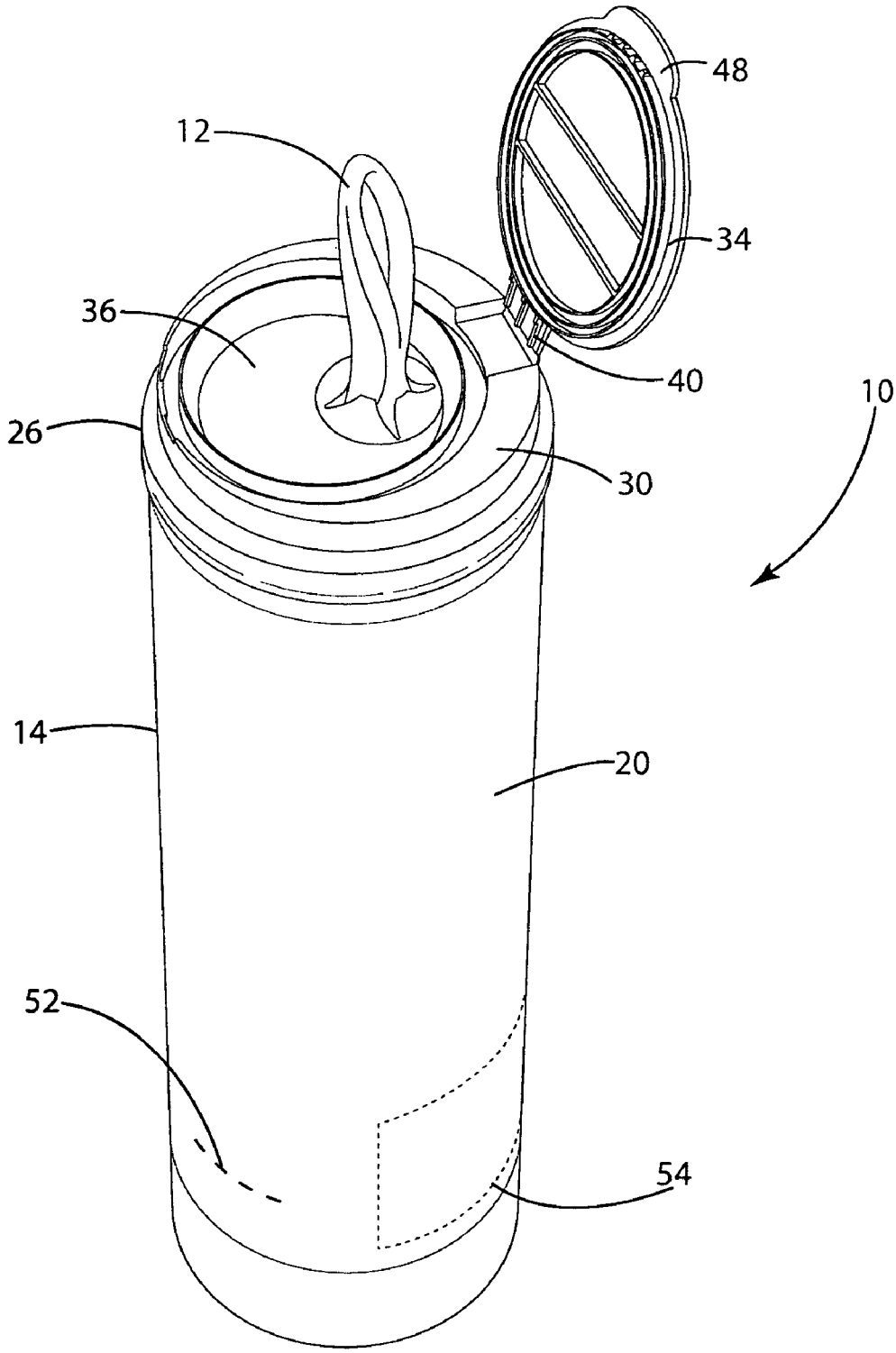
FIG. 1 a perspective view of the dispenser system of one embodiment of the present invention with the lid open.

A customizable disposable paper wipe system 10 in accordance with one embodiment of the present invention is shown in FIG. 1. The system 10 generally includes a supply of dry, but absorbent, paper wipes 12 that are contained in a dispenser 14. The system 10 is provided to a consumer with dry wipes, and the consumer mixes the desired cleaning agent and adds it to the dispenser 14 where it is absorbed by the wipes 12. The consumer can then use the wipes 12 just as though they were conventional pre-moistened wipes.

Figure 2:
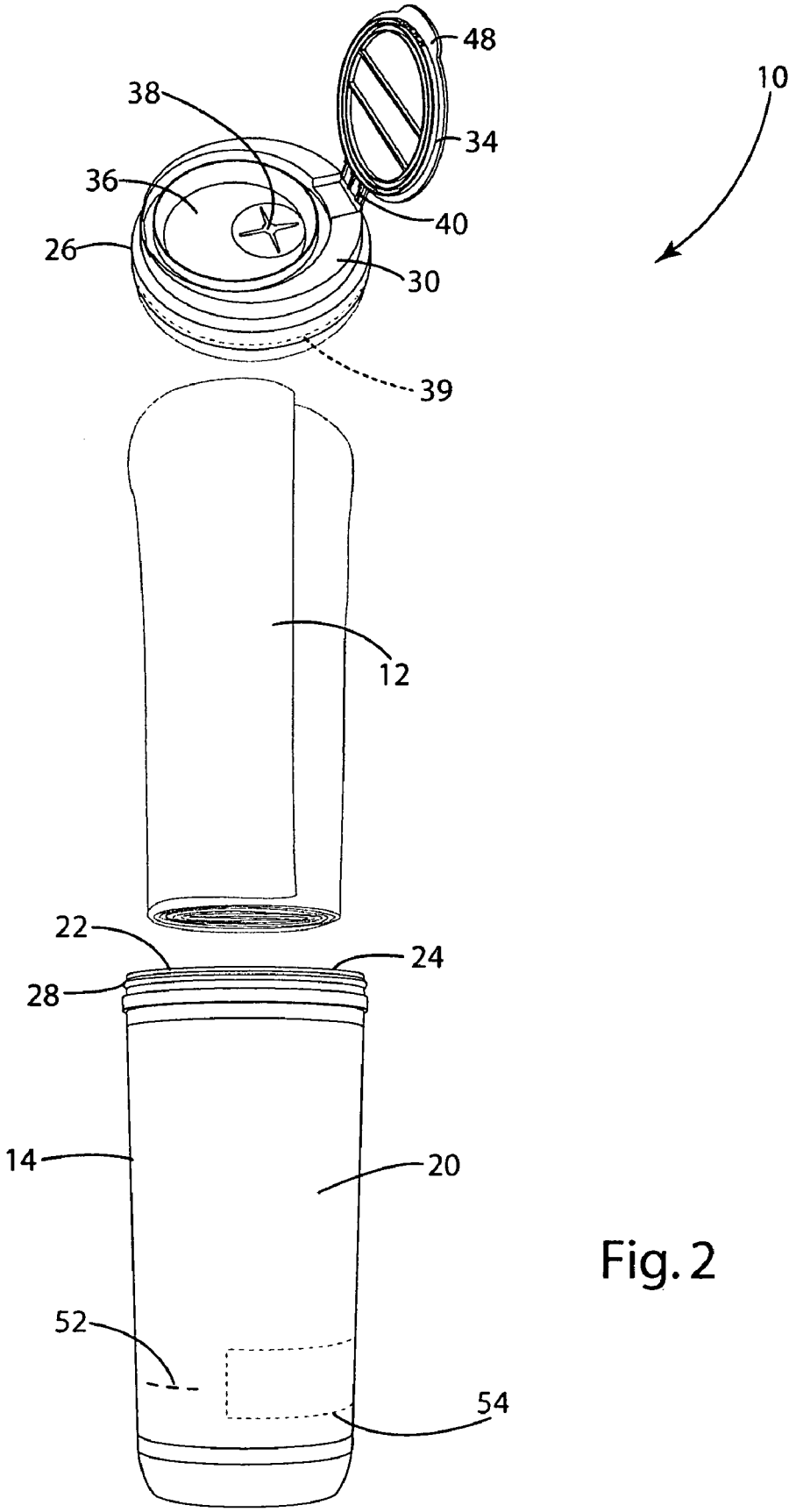
FIG. 2 is an exploded view of the system.
Figure 3:
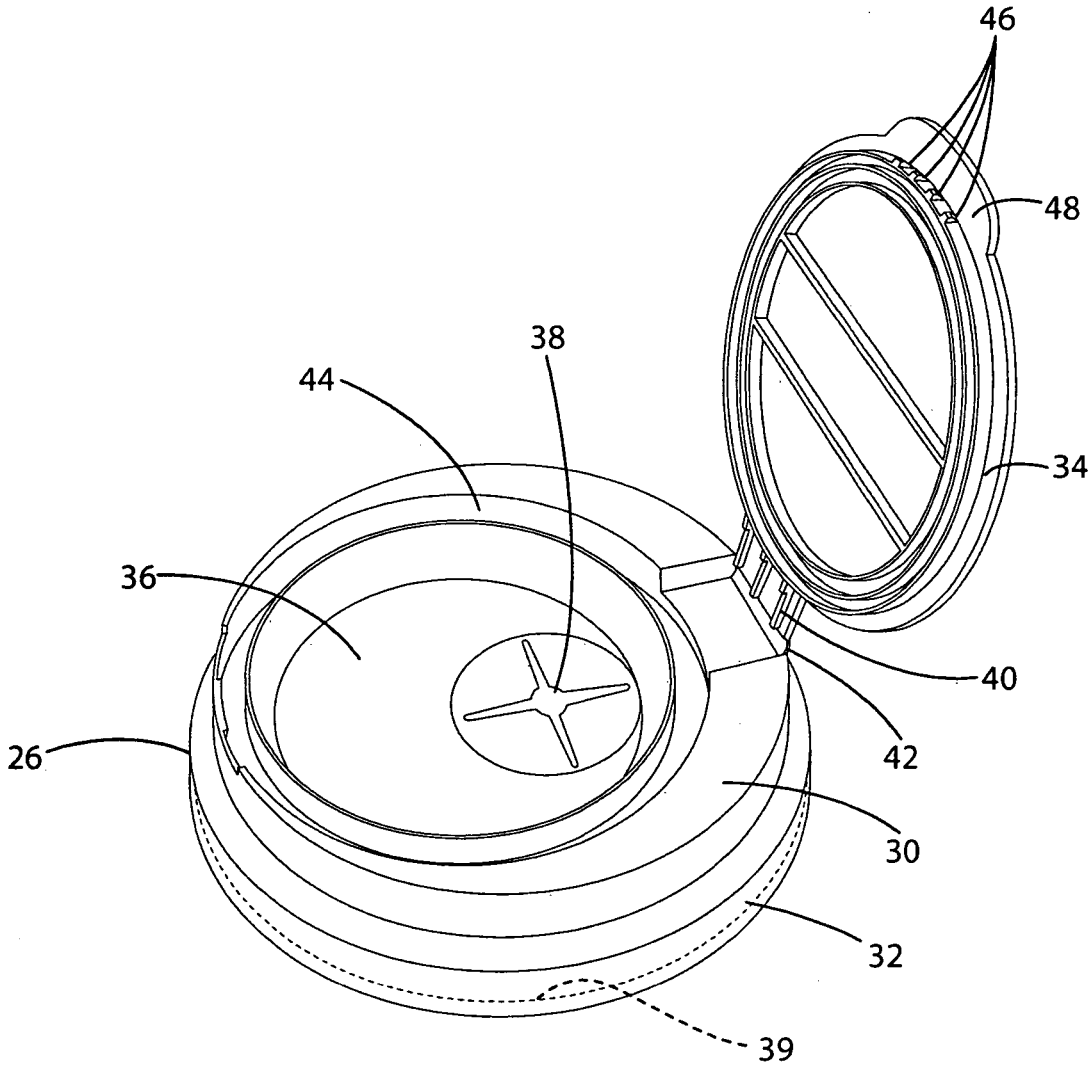
FIG. 3 is a perspective view of the closure.

Referring now to FIGS. 1–3, the dispenser 14 of the illustrated embodiment includes an elongated cylindrical body 20 defining an elongated cylindrical void 22 to contain the wipes 12. In this embodiment, the open end 24 of the cylindrical body 20 is configured to receive a closure 26, for example, by shaping the open end 24 to include a snap ring 28 or threads (not shown). The closure 26 closes the cylindrical void 22 to provide a closed space for containing the wipes 12 and the cleaning agent. Referring now to FIG. 3, the closure 26 of the illustrated embodiment generally includes a top wall 30, a skirt 32 and a flip lid 34. The top wall 30 is generally circular and includes a circular shoulder 44 that is contoured to receive the lid 34 and to define a relatively small recess 36 below the lid 34. The top wall 30 defines a wipe dispensing slot 38 through which wipes can be withdrawn from the dispenser 14. In this embodiment, the slot 38 is generally "+"-shaped providing a relatively close fit with the wipes 12. The close fit between the slot 38 and wipes 12 squeezes excess cleaning agent from each wipe 12 as it is withdrawn for the dispenser 14 and provides little space for excess cleaning agent to spill from the dispenser 14 if tipped upside down. The lid 34 may be manufactured from a resilient material that permits the portions of the lid 34 defining the slot 38 to flex as each wipe 12 is withdrawn. In the illustrated embodiment, the skirt 32 corresponds in shape with the open end 24 of the cylindrical body 20 so that the skirt 32 may be tightly fitted over the open end 24. In this embodiment, a narrow rib 38 extends around the interior of the skirt 32 to be snap-fitted over the snap ring 28 on the open end 24. The skirt 32 may alternatively be configured to be fitted inside (rather than outside) the open end 24 or it may include threads or other fastening mechanism. In the illustrated embodiment, the lid 34 is an integral part of the closure 26. The lid 34 is secured to the remainder of the closure 26 by a bridge 40. The bridge 40 includes a thinned region 42 that functions as a living hinge permitting the lid 34 to flip over and be snap-fitted into the shoulder 44. The lid 34 and/or shoulder 44 may include a plurality of protrusions 46 that create a snap-fit between the lid 34 and shoulder 44. The lid 34 may also include a tab 48 that extends beyond the shoulder 44 where it is readily accessible to facilitate opening of the lid 34. The dispenser 14 and closure 26 may be manufactured using any of a variety of known manufacturing techniques and apparatus. For example, the dispenser 14 may be blow molded and the closure 26 may be injection molded. The dispenser 14; and closure 26 may be manufactured from HDPE, LDPE or other conventional materials, and can be transparent, translucent or opaque.

As noted above, the system 10 also includes a plurality of disposable paper wipes 12 that are contained within dispenser 14. In the illustrated embodiment, the paper wipes 12 are conventional disposable paper wipes that are rolled into a standard roll. The wipes 12 may be separated from one another by a line of perforations that retain the wipes 12 in a roll, but permit relatively easy separation of a wipe 12 from the roll when desired. The wipes 12 may be manufactured from a variety of conventional disposable wipe materials, such as cellulose, polyester, polyethylene or blends of the fore mentioned. The weight of the wipes (when dry) may vary from application to application, but in at least one application is approximately 1.8 ounces per square yard. These products are available from a variety of well known suppliers using different manufacturing techniques. For example, wipes sold by DuPont under the tradename Sontara, which are 50% cellulose and 50% polyester and have a weight of 1.8 ounces per square yard, are suitable for this application.

Figure 4:
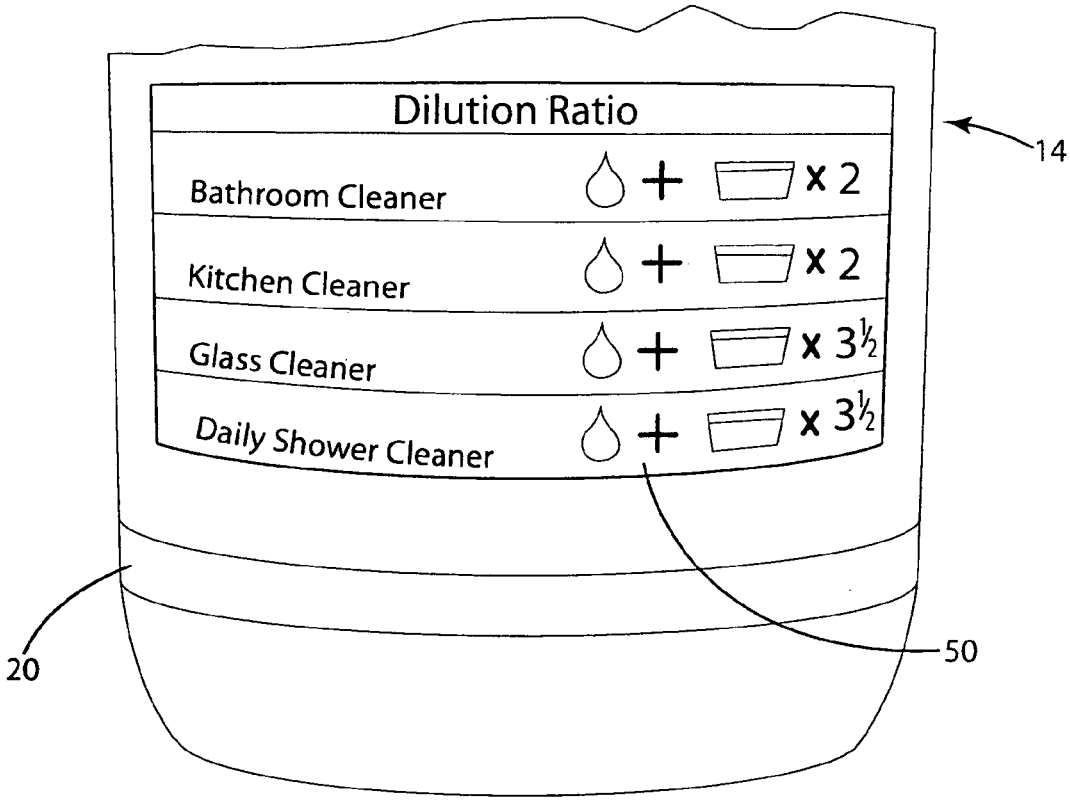
FIG. 4 is an enlarged view of a portion of the dispenser.

The cleaning agent is added to the paper wipes 12 by the consumer. The cleaning agent may be any of a variety of different cleaning agents, such as bathroom cleaner, kitchen cleaner, glass cleaner or shower cleaner. In typical applications, the cleaning agent is prepared by combining a conventional or concentrated cleaner with a specific amount of water or other diluent. For example, the cleaning agent may be prepared by combining a standard or concentrated kitchen cleaner with a specific amount of water. In one embodiment, the amount of diluent remains constant from one cleaner to another and only the amount of cleaner added to the diluent is changed. This facilitates easy preparation by the consumer. In this embodiment, the dispenser 14 includes a visual indication, such as water fill line 52, to provide the consumer with a visual indication of the amount of diluent to be added to the dispenser 14 when preparing the cleaning agent. The amount of cleaner is also predetermined and presented to the consumer on the dispenser 14, for example, on a legend 50 printed on the exterior of the dispenser 14 (See FIG. 4). In alternative applications, different cleaning agents may be prepared using a single cleaner with different dilution ratios. For example, a cleaning agent for use in the kitchen may include a more diluted version of a cleaning agent for use in cleaning glass. This permits a consumer to use its existing supply of cleaning agents to prepare pre-moistened wipes when they are desired. In another alternative embodiment (not shown), the amount of cleaning agent added to the dispenser may remain constant from one application to another and the amount and/or type of diluent may vary. In this alternative, the diluent fill line (e.g. water fill line 52) may be replaced by a cleaning agent fill line and the legend may specify the amount of diluent to be added to different cleaning agents. As a further alternative (not shown), the amount of cleaning agent and the amount of diluent (and/or type of diluent) are subject to change from one cleaning application to another. In yet another alternative embodiment, the cleaning agent may be obtained at a ready-to-use concentration that can be used with the wipes without dilution.

The system 10 is sold to consumers with dry wipes 12 and a dispenser 14 appropriate for use with pre-moistened wipes. At the time that the wipes 12 are sold to the consumer, they have not been pre-moistened by any cleaning agents. The dispenser 14 is, however, provided with instruction for preparing and adding the desired cleaning agent to the wipes 12. If desired, the dry wipes 12 can be sold separately as a refill for existing dispensers 14. There are several methods for moistening the wipes 12. For example, the wipes 12 may be moistened by (a) removing the closure 26 from the dispenser 14, (b) adding the appropriate amount of diluent (e.g. water) to the dispenser 14 by filling the dispenser up to the diluent fill line 52, (c) adding the appropriate amount of the desired cleaning agent to the dispenser 14 as specified by the legend 50, (d) mixing the diluent and cleaning agent within the dispenser 14, (e) inserting the wipes 12 in the dispenser 14, (f) feeding the first wipe 12 through wipe dispensing slot 38, (g) returning the closure 26 to the dispenser 14 and (h) inverting the dispenser for a specified period of time (e.g. 15 minutes). Alternatively, the diluent and cleaning agent can be mixed outside of the dispenser 14 in a suitable container, such as a measuring cup, and then added to the dispenser 14. The dispenser 14 can be reused by providing a new supply of dry wipes 12. It may be desirable to rinse the dispenser 14 prior to reuse.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A method of marketing disposable paper wipes to consumers, comprising the steps of:

providing a dispenser for holding a plurality of wipes;

providing a supply of dry wipes for use in the dispenser;

determining appropriate dilution ratios for a plurality of different cleaning agents;

providing the dispenser with a legend indicating amounts of a plurality of alternative cleaning agents to be added to the dry wipes as a function of said determining step;

providing the dispenser with a single fill line for a diluent as a function of said determining step, the single fill line being used as a fill line for the diluent with each of the alternative cleaning agents; and marketing the dry wipes contained in the dispenser to a consumer for use as a customizable disposable wipe system.

2. The method of claim 1 wherein said step of providing a dispenser is further defined as providing a dispenser having a closure with a wipe dispensing slot.

3. The method of claim 1 wherein said step of providing a dispenser is further defined as providing a dispenser having a closure with a wipe dispensing slot and a removable lid covering said dispensing slot to provide selective access to the wipe dispensing slot.

* * * * *